United States Patent [19]

Blake

[11] Patent Number: 4,656,667

[45] Date of Patent: Apr. 14, 1987

[54] FIRE HELMET AND THE LIKE

[75] Inventor: Bruce H. Blake, Lexington, Ky.

[73] Assignee: E. D. Bullard Company, Sausalito, Calif.

[21] Appl. No.: 715,621

[22] Filed: Mar. 25, 1985

[51] Int. Cl.[4] ..... A42B 3/00

[52] U.S. Cl. ..... 2/5; 2/412; 428/920

[58] Field of Search ..... 2/410, 5, 6, 7, 411, 2/412; 428/920, 286, 287, 250, 282

[56] References Cited

U.S. PATENT DOCUMENTS

| | | | |
|---|---|---|---|
| 1,722,869 | 7/1929 | Vanusek | 2/5 |
| 2,381,524 | 8/1945 | Taylor | 2/7 |
| 2,709,667 | 5/1955 | Grubb et al. | 2/5 X |
| 3,286,275 | 11/1966 | Marchello | 2/411 |
| 3,647,609 | 3/1972 | Cyba | 428/920 X |
| 4,051,555 | 10/1977 | Daly | 2/412 |
| 4,134,155 | 1/1979 | Robertson | 2/412 |
| 4,397,045 | 8/1983 | Schonwetter et al. | 2/5 |

FOREIGN PATENT DOCUMENTS

| | | | |
|---|---|---|---|
| 2941019 | 4/1981 | Fed. Rep. of Germany . | |
| 397985 | 10/1935 | United Kingdom . | |
| 2075820 | 11/1981 | United Kingdom | 2/5 |

*Primary Examiner*—Peter Nerbun

*Attorney, Agent, or Firm*—Thomas M. Freiburger

[57] ABSTRACT

An improved impact barrier structure for fire helmets and the like including a hard outer shell with a relatively thick inner liner in which a layer of flaccid material is interposed between the outer shell and inner liner in intimate heat conducting relation to the outer shell. The layer of flaccid material provides a heat sink for the outer shell to prolong the mechanical characteristics of the outer shell when it is exposed to high temperature sources of radiant or convection heating as in fire fighting operations.

11 Claims, 7 Drawing Figures

FIRE HELMET AND THE LIKE

DESCRIPTION

1. Field of the Invention

This invention relates to impact barriers which are exposed to intense radiant heat in use and more particularly to improved fire helmets and the like.

2. Background of the Invention

Impact barriers are designed to protect a selected body by limiting both the penetration of impacting objects through the barriers to such body and the transfer of shock force from impacting objects by the barrier to such body. In a fire helmet, for example, the shell of the helmet must have sufficient strength and rigidity to prevent an impacting object from penetrating it and yet the shell of the helmet must have sufficient resilience or "give" to reduce or distribute the shock of an impacting force so that it can be absorbed or cushioned by the helmet structure.

Helmet structures have been designed according to the prior art which are highly effective at normal atmospheric temperatures. Such helmet structures have comprised an outer shell of relatively hard material to resist penetration by impacting objects but thin enough to be deformed by large impacting forces. The outer shell is provided with a thick contacting inner liner of softer material selected to provide progressive resistance to deformation of the outer shell. Thus, the inner liner distributes and cushions the shock of impacting forces.

However, when prior art fire helmet structures are exposed to high temperatures and to high temperature radiant heat sources in particular, the outer shell will soften in a relatively short time, allowing penetration of impacting objects and excessive deformation of the helmet structure. If the outer shell is made thicker, it will withstand radiant heating for a longer period of time but the helmet structure will then transfer excessive shock forces in the normal ambient atmospheric temperature range.

It is the primary object of this invention to provide an impact barrier structure for fire helmets and the like which is at least equal in effectiveness to prior art structures and yet will withstand high temperature radiant heating for an extended period of time.

SUMMARY OF THE INVENTION

According to this invention, an improved impact barrier for fire helmets and the like including a layer of hard material in non-adhesive contact with a relatively thick layer of relatively softer material is provided. The improvement comprises a layer of flaccid material interposed between the layer of hard material and the layer of softer material with the layer of flaccid material being adhered to the layer of hard material in intimate heat exchanging relation thereto.

BRIEF DESCRIPTION OF THE DRAWING

This invention will be more fully understood from the following detailed description of a preferred embodiment thereof when read in conjunction with the appended drawing wherein.

DESTAILED DESCRIPTION OF THE INVENTION

Figure 1:
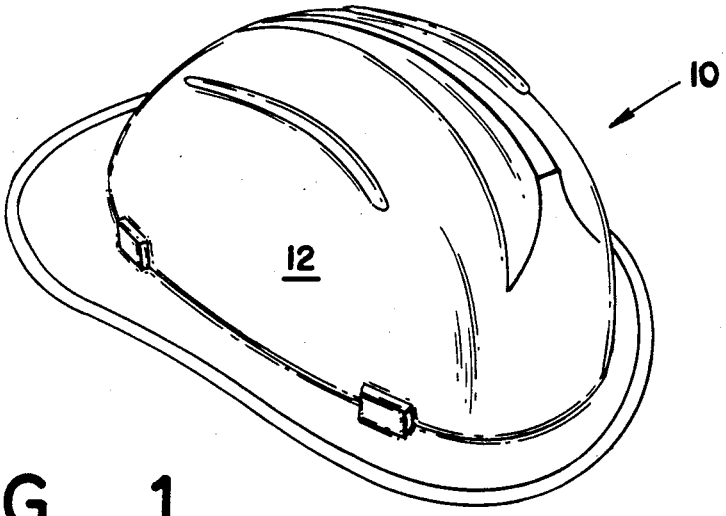
FIG. 1 is a perspective view of an impact barrier in the form of a fire helmet to which this invention is applicable.

Referring to FIG. 1 a fire helmet 10 to which this invention is applicable is shown in perspective. Such fire helmet may be, for example, one which is manufactured and sold by E. D. Bullard Company under Model No. 2100 comprising a molded outer shell 12 made of a polyphthalate carbonate compound of the Lexan product family sold by General Electric Company under Product No. 4831. Such material is chosen for use because its physical properties make it hard enough to resist penetration by impacting objects normally encountered in fire fighting operations and yet flexible enough to absorb the shock produced thereby.

Figure 4:
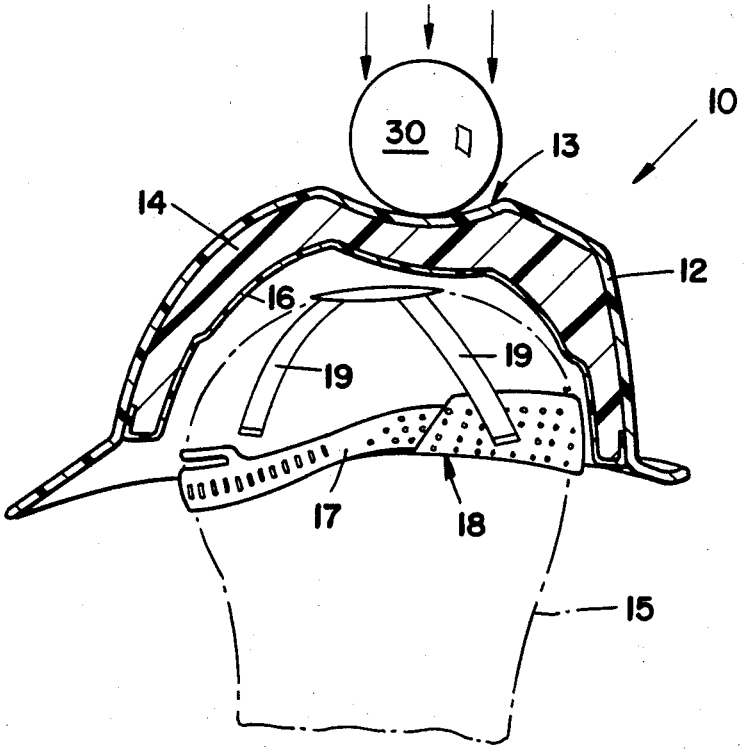
FIG 4 (PRIOR ART)
FIG. 4 is a cross-sectional view similar to FIG. 2 but of a fire helmet structure according to the prior art mounted on a head form indicated by dot-dash lines and shown at the moment of impact by a given mass at a given force under normal atmospheric temperature conditions.

Referring to FIG. 4 the outer shell 12 is made thin enough so that it will deform as indicated at 13 when impacted by an object to thereby cushion the shock of such impact. In order to enhance the cushioning effect, the helmet structure includes a relatively thick inner liner 14 made of molded polystyrene foam which conforms to the inside shape of the outer shell 12. The density of the foam layer 14 is selected to provide progressive resistance to deformation of the outer shell 12 in order to distribute the impacting force and further cushion the shock thereof.

The foam layer 14 is held in contact with the outer shell 12 by means of a thin vacuum formed inner shell 16 which may be made of acrylinitrile butadience styrene sheet material, for example. The helmet structure 10 is dimensioned to receive the head of the wearer with a given spacing between the inner shell 16 and the head of the wearer.

To this end the helmet structure 10 is provided with a suspension system 18 comprising a head band 17 and straps 19 which are shown semi-schematically in the drawing. The suspension system 18 supports the helmet structure 10 in spaced relation on the head of the wearer (indicated by the head form 15 shown in dot-dash lines in FIG. 4), in such a way as to avoid deflection of the helmet structure 10 into contact with the head of the wearer. The helmet structure may also be provided with a chin strap assembly adapted to co-operate with the suspension system 18 in order to act as a harness in securing the helmet structure 10 to the head of the wearer as is well known in the art.

Figure 2:
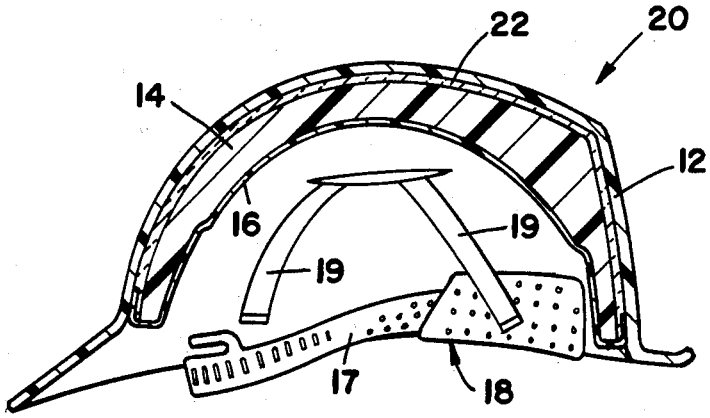
FIG. 2 is a cross-sectional view of a structure for the fire helmet of FIG. 1 according to one embodiment of this invention with the helmet's suspension system shown semi-schematically in full.

Referring to FIG. 2, a helmet structure 20 embodying the teaching of this invention is shown in cross-section. The helmet structure 20 may be substantially identical to the helmet structure 10 of FIG. 4 but for the improvement of this invention. Therefore the same reference numerals are used in FIGS. 2 and 4 to identify identical elements of the structures. According to the teaching of this invention, a layer 22 of flaccid material is interposed between the inner liner 14 and the outer shell 12. The flaccid material of the layer 22 is selected for minimum mechanical strength and appropriate heat conducting properties as will be discussed more fully hereinafter.

Figure 3:
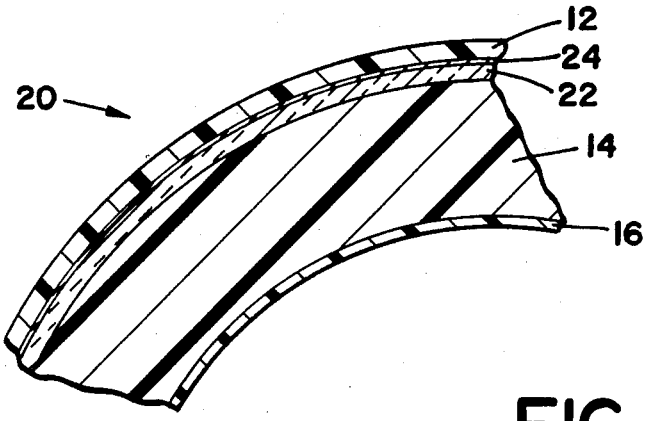
FIG. 3 is an enlarged view of a portion of the helmet structure of FIG. 2.

Referring to FIG. 3 the layer 22 is placed in intimate heat conducting contact with the inner surface of the outer shell 12. The entire contacting surface of the layer 22 is preferably adhered to the inner surface of the outer shell 12 by means of a thin layer 24 of a glue or other suitable adhesive in order to insure intimate heat conducting contact and positive positioning of the layer 22.

According to the teaching of this invention the layer 22 may be made of a felt, cloth or sheet material capable of absorbing heat from the outer shell 12 without changing the mechanical properties of the outer shell 12. Thus, the layer 22 acts solely as a heat sink, prolonging the time required to raise the outer shell to a given temperature when exposed to exterior heating as by means of a high temperature radiant heat source. The function of the flaccid heat sink provided by the layer 22 is to enable the outer shell 12 to retain its stiffness and impact resistance over a larger temperature range and for a longer period of time when exposed to given exterior heating effects.

According to one embodiment of this invention as actually built and successfully tested, the layer 22 was made of a wool felt material which was obtained from Standard Felt Company, Inc. of Blue Island, Ill. under Product No. F-13. The layer 22 was 0.070 inch thick and had a density of 18 ounces per square yard.

In addition to wool felt, felt or cloth layers made of cotton or synthetic materials or combinations of wool, cotton and synthetic materials could be used. In preferred embodiments 20' of this invention, as more fully described hereinafter, layers 22' of neoprene sheets are used. The important considerations are that the layer 22 not contribute substantially to the stiffness of the outer shell 12 while at the same time being capable of absorbing heat from the outer shell 12 without providing excessive heat conduction to other portions of the shell 12.

Figure 5:
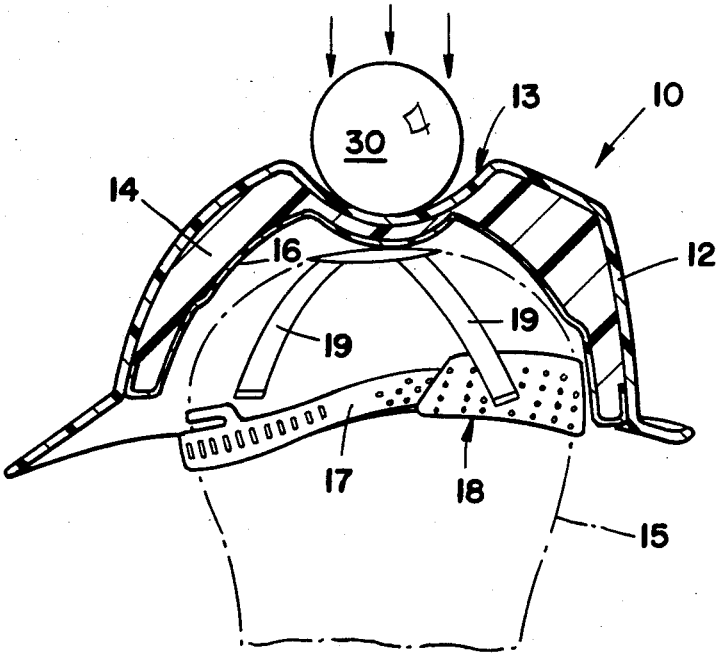
FIG 5 (PRIOR ART)
FIG. 5 is a view identical to FIG. 4 but taken after the helmet structure has been exposed to a given radiant heat source for a given period of time sufficient to produce a failure of the helmet structure.
Figure 6:
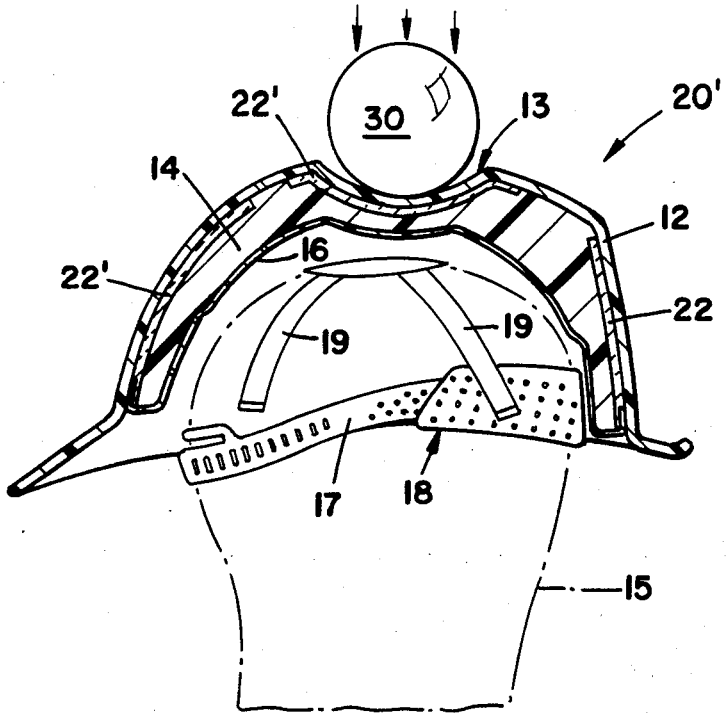
FIG. 6 is a view identical to FIG. 5 but showing a helmet structure according to a preferred embodiment of this invention and illustrating that it will not fail when exposed to the given radiant heat source for the given period of time.
Figure 7:
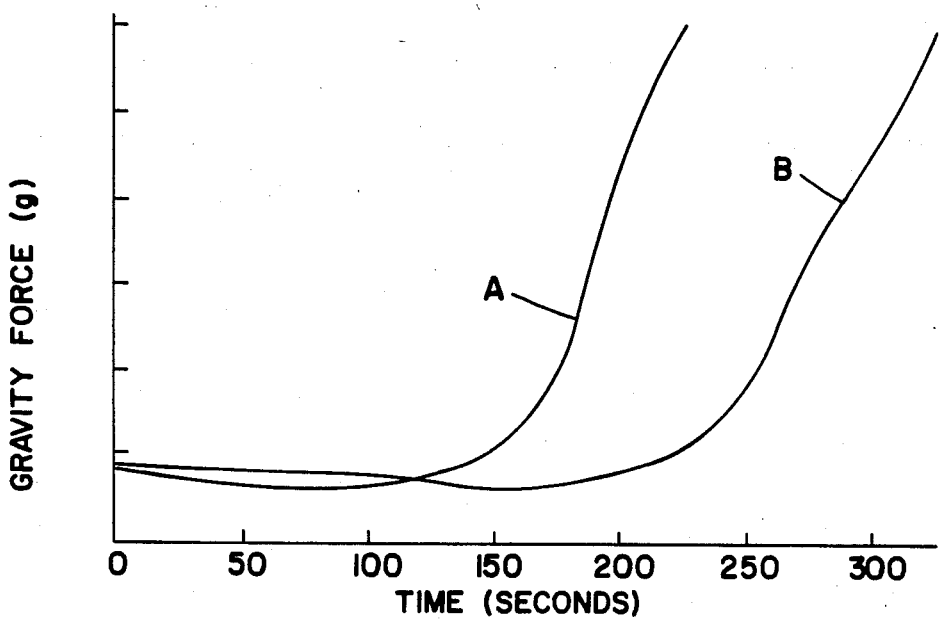
FIG. 7 is a chart illustrating the improvement provided according to the teaching of this invention.

Referring to FIGS. 5, 6 and 7, the results of an actual test of the improved structure according to a preferred embodiment of the subject invention are illustrated. Such test was conducted in accordance with the National Fire Protection Association, Inc. Specification Manual as follows:

A standard black plate thermal indicator was spaced a given distance from a radiant heat source. The power to the radiant source was then adjusted to cause the temperature of the black plate thermal indicator to reach 482 degrees Farenheit in a time period of at least 2 minutes and not to exceed 5 minutes. The black plate thermal indicator was then replaced by a helmet structure 10 according to the teachings of the prior art with the crown of the helmet spaced from the radiant heat source the same distance as was the black plate thermal indicator. The helmet 10 was then impact tested at 25 second intervals and the results of such impact tests were plotted against time as indicated by the graph A in FIG. 7.

The impact test comprised the dropping of a given mass 30 from a given height onto the crown of the helmet 10. The helmet 10 was mounted on a head form 15 and the amount of gravitational force imparted to the head form on impact was measured. The gravitational force measured for each test is plotted on the ordinate against time on the abscissa of FIG. 7 and the points plotted are joined by a line to form graph A.

The helmet structure 10, of course, softened as its temperature increased during the time period of its exposure to the radiant heat source. Such softening may initially result in the slight decrease in the force transferred to the head form 15 indicated by the left hand portion of graph A due to increased deformation of the helmet structure 10. However, when such deformation becomes excessive, the impact forces tranferred to the head form 15 will increase catastrophically corresponding to actual contact of the helmet structure 10 with the head form 15 as shown in FIG. 5 and indicated by the rapid upturn in the right hand portion of graph A of FIG. 7. When the helmet structure 10 contacts the head form 15, due to the impacting force, it is, of course, no longer performing a useful function.

Referring to FIG. 6, the identical test was then repeated using a helmet structure 20' according to a preferred embodiment of this invention and plotted as described above. The heat sink layer 22' of the helmet structure 20' was made of neoprene sheet material 0.031 inch thick having a durometer rating of 65 and a density of 6 to 7 pounds per cubic foot as manufactured and sold by West American Rubber Company of Orange, Calif. This material is preferred over felt or cloth materials, at least for use in fire helmets, because it will not absorb and hold water and, to facilitate manufacture, the heat sink layer was divided into spaced pads 22'.

The pads 22' were placed at the crown, front, back and sides of the helmet structure 20' as indicated in FIG. 6. The results of the test of the helmet structure 20' of FIG. 6 are indicated in FIG. 7 by the graph B.

A comparison of graphs A and B of FIG. 7 shows that at the end of an exposure time of about 200 seconds, the helmet structure 10 of FIG. 5 had failed, whereas the helmet structure 20' of FIG. 6 was still effective. As can be seen from graph B FIG. 7, the helmet structure 20' of FIG. 6 remained effective for more than one minute longer than the helmet structure 10 of FIG. 5. This increase of some 30% represents a very substantial improvement in a fire helmet structure, as will be apparent to those having skill in the art.

The teaching of the subject invention may be applied to impact barriers other than fire helmets. For example, fire wall structures in automobiles and other vehicles could be improved according to the teaching of this invention. It is believed that those skilled in the art will apply obvious modifications of the teaching of this invention to impact barriers other than fire helmets which may be subject to heat in use without departing from the scope of the following claims.

What is claimed is:

1. In an impact barrier structure for fire helmets and the like including an outer layer of hard, impact-deformable material and a relatively thick inner layer of a relatively softer material, the improvement comprising a layer of flaccid material interposed between said layer of hard material and said relatively thick layer of relatively softer material, said layer of flaccid material being of minimal mechanical strength and adhered to said layer of hard material in intimate heat exchanging relation thereto, and having good heat absorbing properties so as to ace as a heat sink for absorbing heat from the outer layer without changing the mechanical properties of the outer layer, and thereby also to delay conduction of heat to the inner layer.

2. The improvement of claim 1 wherein said layer of flaccid material is a neoprene sheet having a durometer rating of about 65.

3. The improvement of claim 1 wherein said layer of flaccid material is a felt sheet selected from the group consisting of wool, cotton and synthetic fibers and combinations thereof.

4. The improvement of claim 1 wherein said layer of flaccid material is a cloth selected from the group consisting of wool, cotton and synthetic fibers and combinations thereof.

5. The improvement of claim 2 wherein said layer of flaccid material has a thickness of about 0.03 inch and a density of about six and one-half pounds per cubic foot.

6. The improvement of claim 3 wherein said layer of flaccid material has a thickness of about 0.07 inch and a weight of about one pound per square yard.

7. The improvement of claim 1 wherein said layer of hard material is made of polyphthalate carbonate, said relatively thick layer of a relatively softer material made of an expanded polystyrene and said layer of flaccid material is made of neoprene having a durometer rating of 65.

8. The improvement of claim 1 wherein said layer of flaccid material is discontinuous over the surface of said layer of hard material.

9. The improvement of claim 1 wherein said layer of flaccid material is adhered to said layer of hard material by means of a layer of glue.

10. The improvement of claim 1 wherein the outer layer is of polyphthalate carbonate material and the relatively thick layer is of expanded polystyrene, and including an inner shell of acrylinitrile butadiene styrene.

11. The improvement of claim 1 wherein said layer of flaccid material is in the form of discrete pads at spaced locations in the fire helmet, whereby the relatively thick inner layer of softer material is in non-adhesive contact with the outer layer where no pad is interposed.

* * * * *